US009999276B2

(12) United States Patent
Adeagbo et al.

(10) Patent No.: US 9,999,276 B2
(45) **Date of Patent: *Jun. 19, 2018**

(54) SOLE STRUCTURES AND ARTICLES OF FOOTWEAR HAVING A LIGHTWEIGHT MIDSOLE WITH SEGMENTED PROTECTIVE ELEMENTS

(71) Applicant: NIKE, Inc., Beaverton, OR (US)

(72) Inventors: Simidele A. Adeagbo, Beaverton, OR (US); Chad C. Grover, Beaverton, OR (US); Kevin W. Hoffer, Portland, OR (US); Matthew J. Holmes, Portland, OR (US); Tamimu A. Shyllon, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 10 days.

This patent is subject to a terminal disclaimer.

(21) Appl. No.: 15/012,464

(22) Filed: Feb. 1, 2016

(65) Prior Publication Data

US 2016/0143391 A1 May 26, 2016

Related U.S. Application Data

(63) Continuation of application No. 13/605,681, filed on Sep. 6, 2012, now Pat. No. 9,282,784.

(51) Int. Cl.
*A43B 13/14* (2006.01)
*A43B 13/18* (2006.01)
(Continued)

(52) U.S. Cl.
CPC ..... *A43B 13/141* (2013.01); *A43B 13/04* (2013.01); *A43B 13/122* (2013.01);
(Continued)

(58) Field of Classification Search
CPC ... A43B 13/187; A43B 13/188; A43B 13/122; A43B 13/125; A43B 13/141;
(Continued)

(56) References Cited

U.S. PATENT DOCUMENTS 4,439,936 A 4/1984 Clarke et al.
5,718,063 A 2/1998 Yamashita et al.
(Continued)

FOREIGN PATENT DOCUMENTS

AU 2005290828 B2 5/2008
DE 19950121 C1 11/2000
(Continued)

OTHER PUBLICATIONS

International Search Report and Written Opinion from PCT/US2013/058280 dated Feb. 18, 2014.
(Continued)

*Primary Examiner* — Ted Kavanaugh
(74) *Attorney, Agent, or Firm* — Banner & Witcoff, Ltd.

(57) ABSTRACT

Sole structures for articles of footwear, including athletic footwear, include: (a) a lightweight foam midsole component for supporting the foot; and (b) a plurality of heavier and/or denser cage components covering selected areas of the midsole component. Spaces are provided between the cage components. These spaces may be sized, shaped, and oriented to define and/or correspond to flexion lines of the foot and/or to produce a more natural flex motion to the sole. The soles additionally may include one or more outsole components, e.g., on bottom surface(s) of the cage component(s) and/or the foam midsole. These sole structures may be engaged with an upper to form a shoe. The uppers may include one or more lace receiving openings supported by
(Continued)

elongated wire or textile components. Methods of making footwear including such uppers and/or sole structures also are described.

20 Claims, 7 Drawing Sheets

(51) Int. Cl.

| | |
|---|---|
| ***A43C 1/04*** | (2006.01) |
| ***A43B 13/04*** | (2006.01) |
| ***A43B 13/12*** | (2006.01) |
| ***A43B 13/16*** | (2006.01) |
| ***A43B 23/02*** | (2006.01) |
| ***A43C 5/00*** | (2006.01) |

(52) U.S. Cl.
CPC ..... *A43B 13/125* (2013.01); *A43B 13/16* (2013.01); *A43B 13/184* (2013.01); *A43B 13/187* (2013.01); *A43B 23/0265* (2013.01); *A43C 1/04* (2013.01); *A43C 5/00* (2013.01)

(58) Field of Classification Search
CPC ... A43B 13/16; A43B 13/184; A43B 23/0225; A43B 23/0255; A43B 23/0265; A43C 1/04
See application file for complete search history.

(56) References Cited

U.S. PATENT DOCUMENTS

| | | | | |
|---|---|---|---|---|
| 6,789,332 | B1 | 9/2004 | Scholz | |
| 7,080,467 | B2 * | 7/2006 | Marvin | A43B 13/203 36/28 |
| 7,941,938 | B2 | 5/2011 | Yu et al. | |
| 7,941,941 | B2 | 5/2011 | Hazenberg et al. | |
| 8,863,407 | B2 | 10/2014 | Nishiwaki et al. | |
| 9,282,784 | B2 * | 3/2016 | Adeagbo | A43B 13/187 |
| 2002/0017036 | A1 | 2/2002 | Berger et al. | |
| 2004/0148803 | A1 | 8/2004 | Grove et al. | |
| 2004/0250446 | A1 | 12/2004 | Greene et al. | |
| 2006/0061012 | A1 | 3/2006 | Hatfield et al. | |
| 2007/0043133 | A1 | 2/2007 | Carvalho et al. | |
| 2007/0161731 | A1 | 7/2007 | Carvalho et al. | |
| 2007/0193065 | A1 | 8/2007 | Nishiwaki et al. | |
| 2007/0266592 | A1 | 11/2007 | Smith et al. | |
| 2009/0013558 | A1 | 1/2009 | Hazenberg et al. | |
| 2010/0154256 | A1 | 6/2010 | Dua | |
| 2010/0263236 | A1 * | 10/2010 | Carboy | A43B 1/0072 36/117.1 |
| 2010/0269376 | A1 | 10/2010 | Flannery et al. | |
| 2011/0088282 | A1 | 4/2011 | Dojan et al. | |
| 2011/0088285 | A1 | 4/2011 | Dojan et al. | |
| 2011/0185590 | A1 | 8/2011 | Nishiwaki et al. | |
| 2011/0277346 | A1 | 11/2011 | Peyton et al. | |
| 2012/0060392 | A1 | 3/2012 | Pan | |
| 2013/0340283 | A1 | 12/2013 | Bell et al. | |

FOREIGN PATENT DOCUMENTS

| | | | |
|---|---|---|---|
| EP | 2074901 | A1 | 7/2009 |
| EP | 2332432 | A1 | 6/2011 |
| FR | 2858623 | A1 | 2/2005 |
| JP | 2000210101 | A | 8/2000 |
| JP | 2007501873 | A | 2/2007 |
| JP | 2007508055 | A | 4/2007 |
| JP | 2008501487 | A | 1/2008 |
| JP | 2009178594 | A | 8/2009 |
| WO | 9208383 | A1 | 5/1992 |
| WO | 2005034670 | A2 | 4/2005 |
| WO | 2007139832 | A2 | 12/2007 |
| WO | 2010038266 | A1 | 4/2010 |
| WO | 2011143056 | A1 | 11/2011 |

OTHER PUBLICATIONS

Non Final Rejection dated Jul. 17, 2015 in U.S. Appl. No. 13/605,681.
Dec. 18, 2015 (CN) First Office Action—App 201380057938.0.
Mar. 16, 2016 (JP) Notification of Rejection—App 2015-531200—Eng Tran.
Mar. 18, 2016 (CA) CA Office Action—App 2,883,764.
Sep. 22, 2016 (KR) Korean Office Action—App 10-2015-7008607.
Apr. 13, 2016 (AU) Australian Office Action—App 2013312454.
May 16, 2017 (EP) Office Action—App. 13765570.0.

* cited by examiner

SOLE STRUCTURES AND ARTICLES OF FOOTWEAR HAVING A LIGHTWEIGHT MIDSOLE WITH SEGMENTED PROTECTIVE ELEMENTS

RELATED APPLICATION DATA

The application is a continuation of U.S. application Ser. No. 13/605,681 entitled "Sole Structures and Articles of Footwear Having a Lightweight Midsole with Segmented Protective Elements," filed Sep. 6, 2012, the contents of which is incorporated herein in its entirety for any and all non-limiting purposes.

FIELD OF THE INVENTION

The present invention relates to the field of footwear. More specifically, aspects of the present invention pertain to sole structures and/or articles of footwear (e.g., athletic footwear) that include a relatively soft and/or lightweight foam midsole component partially covered by more rigid and/or dense protective components.

BACKGROUND

Conventional articles of athletic footwear include two primary elements, namely, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure may provide traction and control potentially harmful foot motion, such as over pronation. The general features and configurations of the upper and the sole structure are discussed in greater detail below.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces), and the upper also may include a heel counter to limit or control movement of the heel.

The sole structure generally incorporates multiple layers that are conventionally referred to as an insole, a midsole, and an outsole. The insole (which also may constitute a sock liner) is a thin member located within the upper and adjacent the plantar (lower) surface of the foot to enhance footwear comfort, e.g., to wick away moisture and provide a soft, comfortable feel. The midsole, which is traditionally attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

Despite the various available footwear models and characteristics, new footwear models and constructions continue to develop and are a welcome advance in the art.

SUMMARY OF THE INVENTION

This Summary is provided to introduce some general concepts relating to this invention in a simplified form that are further described below in the Detailed Description. This Summary is not intended to identify key features or essential features of the invention.

While potentially useful for any desired types or styles of shoes, aspects of this invention may be of particular interest for sole structures of articles of athletic footwear that include basketball shoes, running shoes, cross-training shoes, cleated shoes, tennis shoes, golf shoes, etc.

More specific aspects of this invention relate to sole structures for articles of footwear that include at least some of the following: (a) a foam midsole component having a density of less than 0.25 g/cm$^3$ extending from a rear heel region to a front forefoot region; (b) one or more rear heel cage components covering a portion of a rear heel area of the foam midsole component; (c) one or more forward heel cage components covering a portion of a forward heel area of the foam midsole component, wherein a first space exists between the rear heel cage component(s) and the forward heel cage component(s), and wherein an exterior surface of the foam midsole component may be exposed at the first space; (d) one or more midfoot cage components covering a portion of a midfoot area of the foam midsole component, wherein a second space exists between the forward heel cage component(s) and the midfoot cage component(s), and wherein the exterior surface of the foam midsole component may be exposed at the second space; and (e) one or more forefoot cage components covering a portion of a forefoot area of the foam midsole component, wherein a third space exists between the midfoot cage component(s) and the forefoot cage component(s), and wherein the exterior surface of the foam midsole component may be exposed at the third space. The sole structures additionally may include one or more outsole components, e.g., on the bottom surface(s) of one or more of the cage components and/or the foam midsole component. The spaces between the cage components may be sized, shaped, and oriented so as to define and/or correspond to flexion lines in the substantially transverse (medial side-to-lateral side) direction and/or in the substantially longitudinal (heel-to-toe) direction and/or to produce a more natural motion flexion to the sole structure.

Additional aspects of this invention relate to articles of footwear including sole structures of the various types described above engaged with an upper component. The upper components may include one or more lace receiving or engaging openings or eyelets supported by one or more elongated wire or textile components.

Still additional aspects of this invention relate to methods for making sole structures and/or articles of footwear of the various types described above (and described in more detail below). More specific aspects of this invention will be described in more detail below.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and methods without departing from the scope of the present invention.

I. GENERAL DESCRIPTION OF ASPECTS OF THIS INVENTION

Aspects of this invention relate to sole structures and/or articles of footwear (e.g., athletic footwear) that include a relatively soft and lightweight foam midsole component partially covered by more rigid and/or dense cage (protective) components. More specific features and aspects of this invention will be described in more detail below.

Figure 1A:
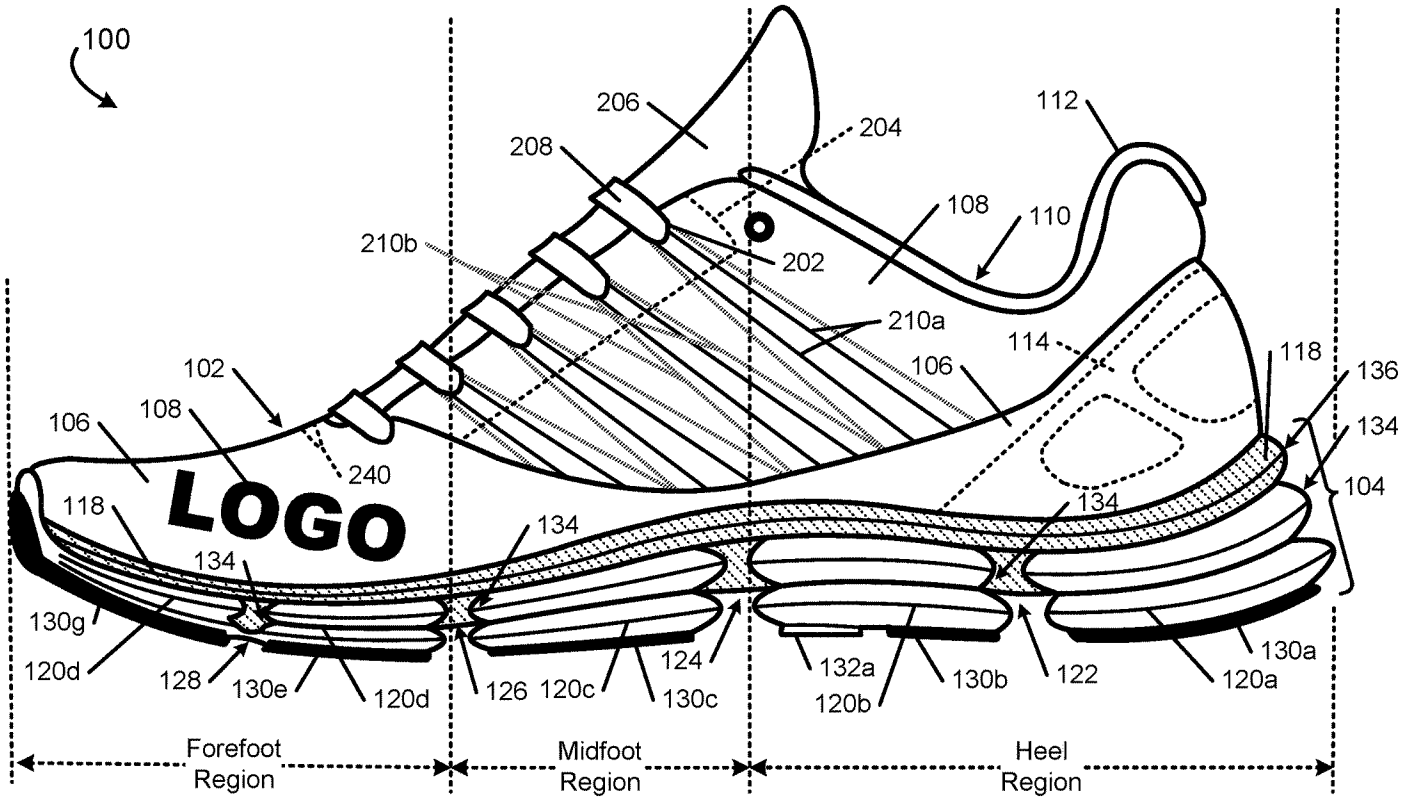
FIGS. 1A through 1D show various views of an article of footwear, including an upper and/or a sole structure in accordance with at least some examples of this invention.
Figure 1B:
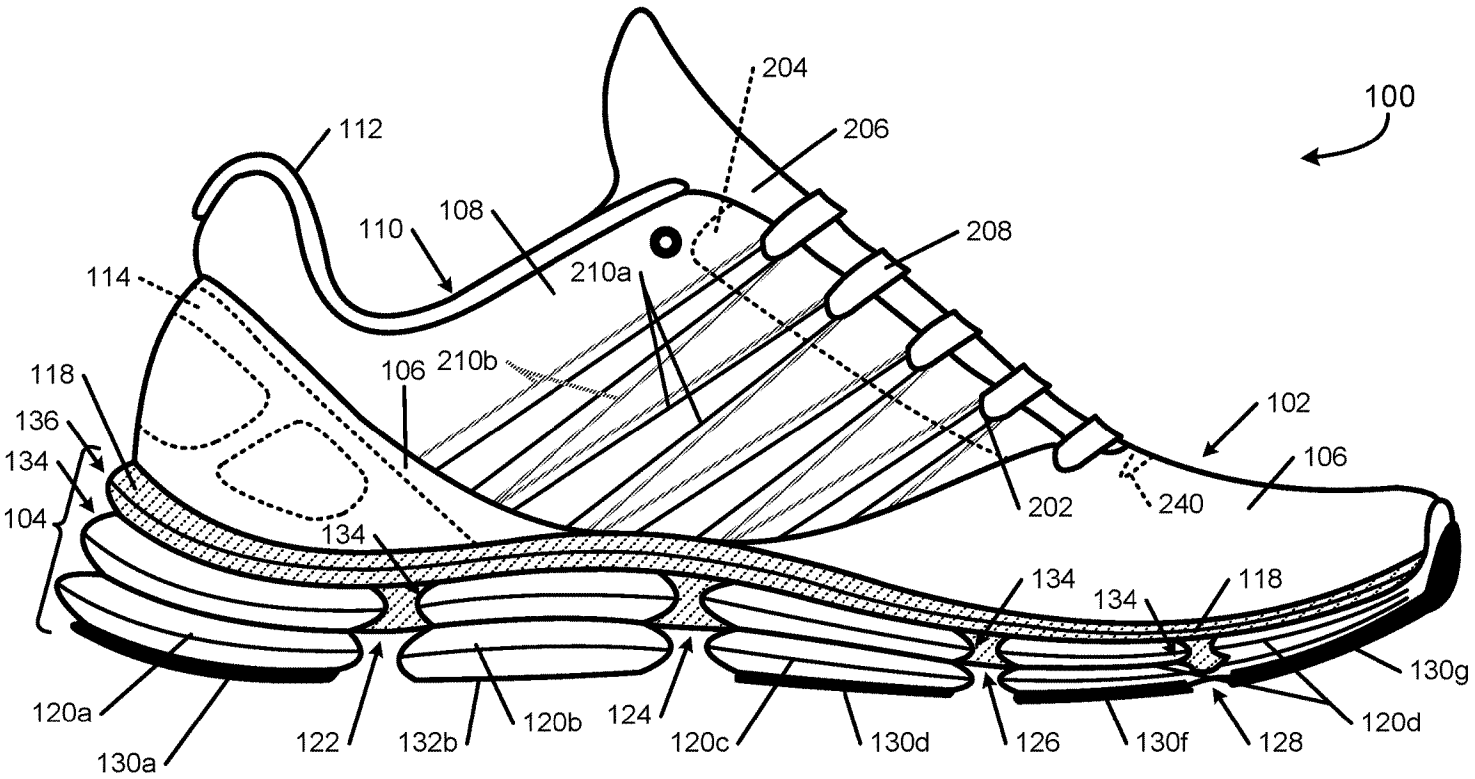
Figure 1C:
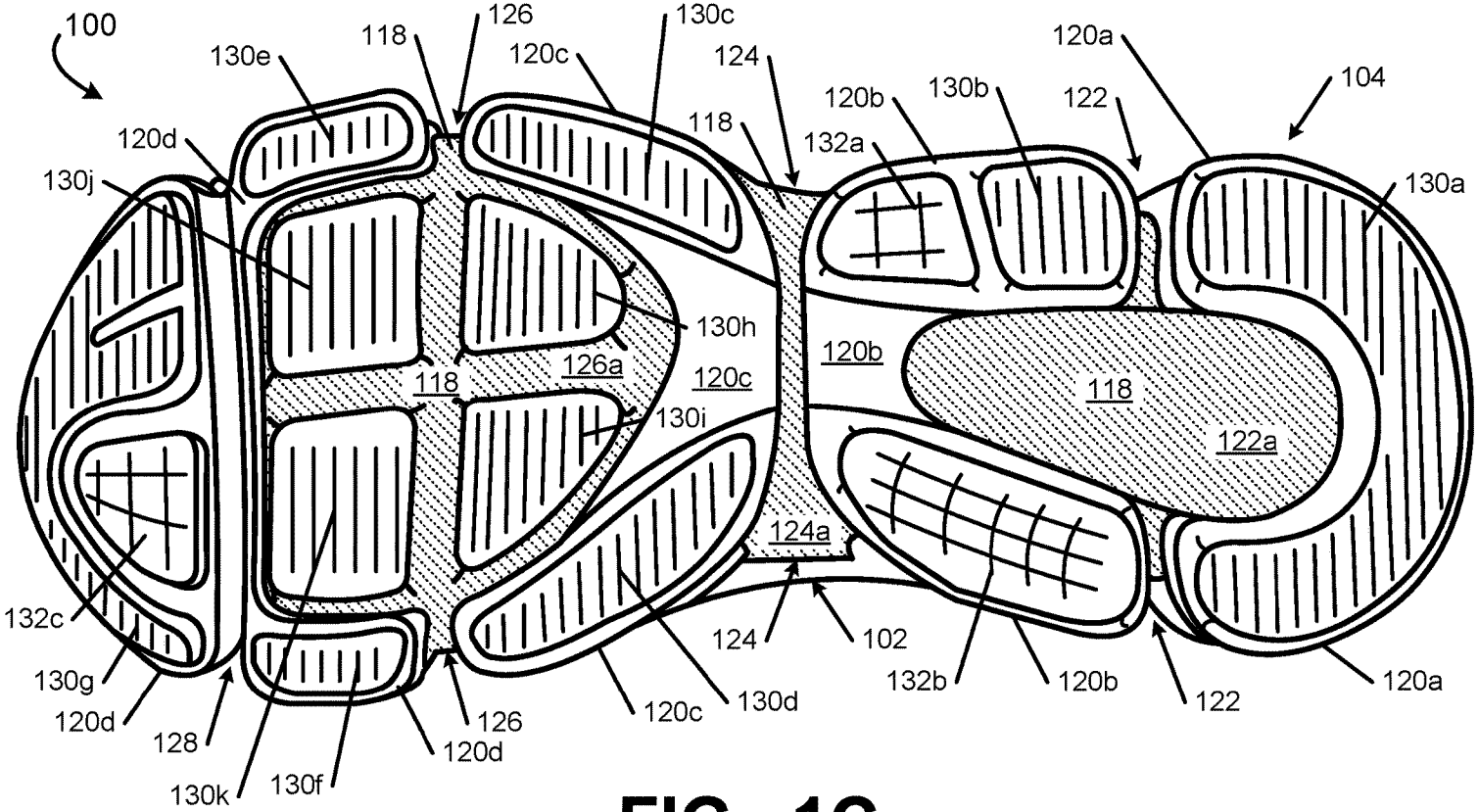
Figure 1D:
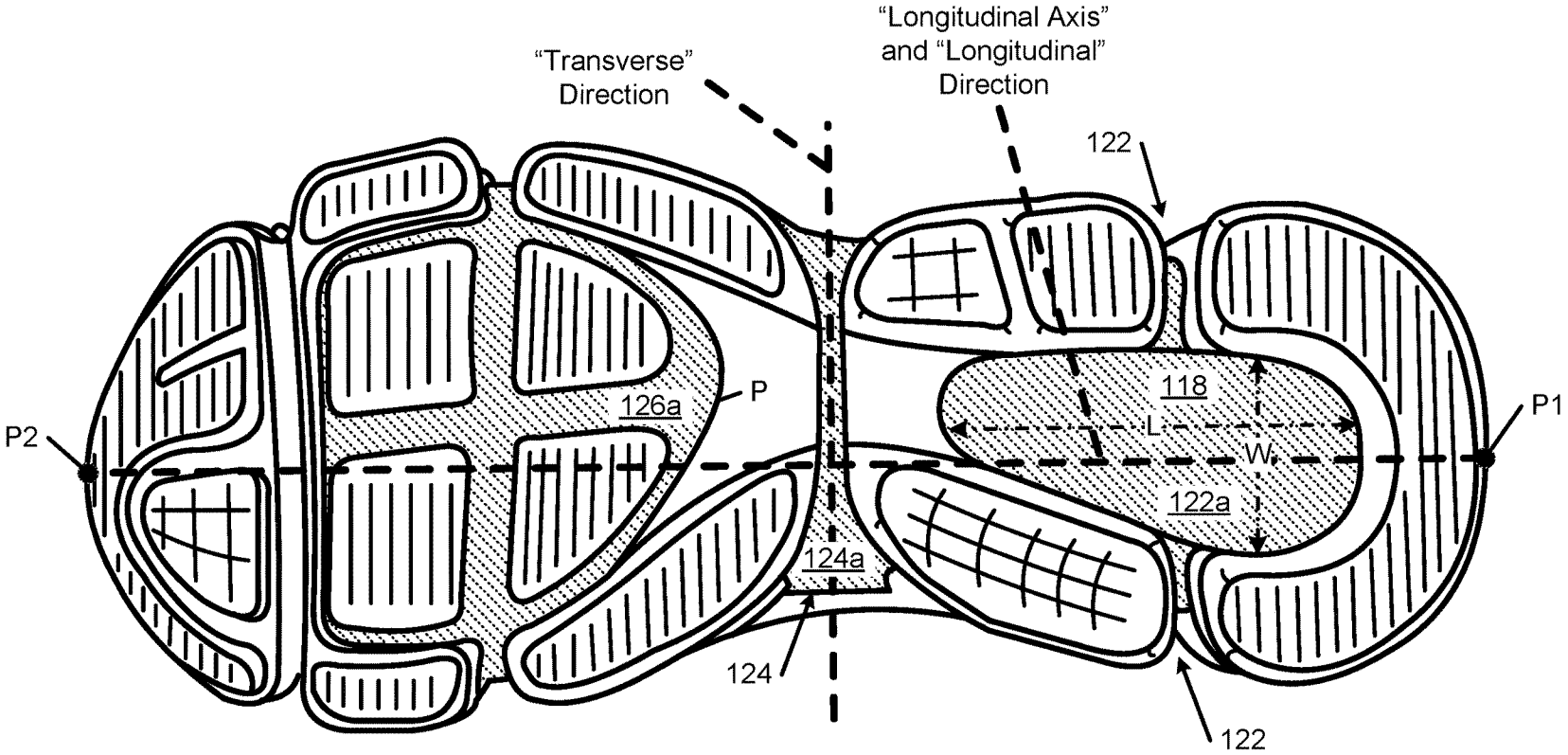

The term "longitudinal direction," as used in this specification, is a direction determined by a line connecting a rearmost heel (or other) point of an item (e.g., see point P1 of the sole structure of FIG. 1D) and the forward most toe (or other) point of the item (e.g., see point P2 of the sole structure of FIG. 1D). If the forward most and/or rearmost locations of a specific item constitute line segments, then the forward most point and/or the rearmost point constitute the mid-point of the corresponding line segment. If the forward most and/or rearmost locations of a specific item constitute two or more separated points or line segments, then the forward most point and/or the rearmost point constitute the mid-point of a line segment connecting the separated points or line segments. The "transverse direction" is orthogonal to the longitudinal direction.

A. Features of Sole Structures and Articles of Footwear According to Examples of this Invention Some aspects of this invention relate to sole structures for articles of footwear and articles of footwear (or other foot-receiving devices), including athletic footwear, having such sole structures. Sole structures for articles of footwear according to at least some examples of this invention may include at least some of the following: (a) a foam midsole component having a density of less than 0.25 g/cm$^3$ (and in some examples, a density of less than 0.2 g/cm$^3$, within the range of 0.075 to 0.2 g/cm$^3$, and even within the range of 0.1 to 0.18 g/cm$^3$) (the foam midsole component may extend from a rear heel region to a front forefoot region, although it need not completely underlie the entire plantar surface of the foot); (b) one or more rear heel cage components covering a portion of a rear heel area of the foam midsole component; (c) one or more forward heel cage components covering a portion of a forward heel area of the foam midsole component, wherein a first space exists between the rear heel cage component(s) and the forward heel cage component(s) (and, optionally, wherein an exterior surface of the foam midsole component is exposed at the first space); (d) one or more midfoot cage components covering a portion of a midfoot area of the foam midsole component, wherein a second space exists between the forward heel cage component(s) and the midfoot cage component(s) (and, optionally, wherein the exterior surface of the foam midsole component is exposed at the second space); and (e) one or more forefoot cage components covering a portion of a forefoot area of the foam midsole component, wherein a third space exists between the midfoot cage component(s) and the forefoot cage component(s) (and, optionally, wherein the exterior surface of the foam midsole component is exposed at the third space). The spaces between the various cage components may function as substantially transverse flexion lines in the sole structures (e.g., to provide increased flexibility to the sole structure). Additionally or alternatively, if desired, separate cage components (separated by a space) may be provided on the lateral and medial sides of the sole structure, e.g., optionally so as to provide substantially longitudinal flexion lines in the sole structure.

The various cage components may be made from the same or different materials without departing from this invention, including materials, such as polymeric foam materials, having a density of greater than 0.2 g/cm$^3$ (and in some examples, a density of greater than 0.25 g/cm$^3$, and in some further examples, having a density within a range of 0.25 g/cm$^3$ to 1 g/cm$^3$ or even within the range of 0.25 g/cm$^3$ to 0.75 g/cm$^3$). As some more specific examples, the various cage components may be made from at least one material selected from the group consisting of: ethylvinylacetate foam, polyurethane foam, phylon foam, phylite material, and a rubber material. In some examples, at least some of the cage components (and optionally all of the cage components) will have a density at least 10% higher than the density of the midsole foam component, and in still further examples, the cage component density will be at least 25% higher, at least 50% higher, at least 100% higher, or even at least 200% higher than the density of the foam midsole component.

Sole structures in accordance with at least some examples of this invention may include outsole components (e.g., made of rubber, phylon, phylite, thermoplastic polyurethane, or the like) on the bottom surface(s) of one or more of the cage components and/or the foam midsole component (e.g., in one of the exposed spaces). The outsole components may provide, for example, hardness, strength, wear resistance, and traction (e.g., by providing texture, cleats, or other traction-enhancing structures on the bottom surface of the sole structure). In some example structures according to this invention, several independent outsole components will be provided at various discrete locations around the bottom of the sole structure.

If desired, in accordance with at least some examples of this invention, at least some portion of outer side edges of one or more of the rear heel cage component(s), the forward heel cage component(s), the midfoot cage component(s), and/or the forefoot cage component(s) may include a billowed structure (described in more detail below). Additionally or alternatively, if desired, at least some portion of the foam midsole component (e.g., an upper edge of the foam midsole component) may include a billowed structure, e.g., adjacent the billowed structure of the one or more cage components (if they are billowed). While any number of individual billow structures are possible on the various components without departing from this invention, in some examples, in a top-to-bottom direction, an individual sole structure may include from 2 to 8 billows, and in some examples, from 3-6 billows. In some more specific examples, the cage components will include more billows than the foam midsole component, for example, with the cage components having from 2-6 billows (and in some examples, from 2-4 billows) and the foam midsole component having from 1-3 billows (and in some examples, from 1-2 billows).

One way of saving weight in a sole structure according to some examples of this invention is to leave relatively large areas of the lightweight foam midsole component exposed in the final sole structure, e.g., in the spaces defined between the cage components (i.e., by reducing the amount of cage material). For example, the rear heel and forward heel cage components may be shaped so as to define a central open area as the first space (through which the foam midsole component may be exposed) that constitutes 20% to 50% of the total surface area enclosed by the combined outer perimeters of the rear heel and forward heel cage components. As another example, the midfoot and forefoot cage components may be shaped so as to define a central open area as the third space (through which the foam midsole component is exposed) that constitutes 20% to 50% of the total surface area enclosed by the combined outer perimeters of the midfoot and forefoot cage components. The shapes of the spaces defined between the cage components may be any desired shapes, including oval shaped, elliptical shaped, rectangular shaped, U-shaped, irregular shaped, etc.

As another example feature, the spaces between the cage components may be provided so as to correspond to flexion lines in the substantially transverse (medial side-to-lateral side) direction and/or in the substantially longitudinal (heel-to-toe) direction. The spaces between the cage components may be sized, shaped, and oriented to produce a more natural motion flexion to the sole structure.

Still additional aspects of this invention relate to articles of footwear including uppers (e.g., of any desired design, construction, or structure, including conventional designs, constructions, or structures) engaged with sole structures of the various types described above. While any desired upper construction is possible, in some example footwear structures in accordance with this aspect of the invention, the upper may include an instep opening having a plurality of lateral lace support elements on its lateral side and a plurality of medial lace support elements on its medial side. One or more of the lateral and/or medial lace support elements may include one or more elongated wire or textile components that loop around one of the lace receiving openings or eyelets, e.g., to support the lace and help wrap the upper around the wearer's foot when the lace is tightened. The elongated wire or textile components may include: (a) a portion that loops around the lace receiving opening or eyelet and is fixed to an exterior surface of the upper and (b) a portion that is not fixed to the exterior surface of the upper. If desired, at least some of the lace receiving openings or eyelets may include two or even more elongated wire or textile components looped or at least partially surrounding them.

In still other example structures in accordance with this invention, the elongated wire or textile components supporting the lace receiving openings or eyelets will include: (a) a first end located between the upper and an upper surface of the foam midsole component, (b) a second end located between the upper and the upper surface of the foam midsole component, and (c) an intermediate portion between the first end and the second end that loops around one or more lace receiving openings or eyelets. The intermediate portion may be fixed to the upper at least in the area around the lace receiving opening or eyelet.

B. Method Features

Additional aspects of this invention relate to methods of making articles of footwear or various components thereof. One more specific aspect of this invention relates to methods for making sole structures for articles of footwear of the various types described above. While the various components and parts of the sole structures and articles of footwear according to aspects of this invention may be made in manners that are conventionally known and used in the art, examples of the method aspects of this invention relate to combining the sole structure and/or footwear parts and engaging them together in manners that produce the various structures described above. As some more specific examples, if desired, the upper may be engaged to the sole structure using lasting procedures, cements, adhesives, mechanical connectors, etc., including methods that are conventionally known and used in this art.

As described above, the lace receiving openings or eyelets may be supported by elongated wire or textile components. These wire or textile components may be engaged with the upper material and/or the overall shoe structure in any desired manner without departing from this invention, including through the use of embroidery techniques, adhesives, sewing, fusing techniques, etc. The ends of the wire or textile components may be secured between the upper and the upper surface of the sole structure, e.g., by adhesives or cements.

Given the general description of features, aspects, structures, and arrangements according to the invention provided above, a more detailed description of specific example articles of footwear and methods in accordance with this invention follows.

II. DETAILED DESCRIPTION OF EXAMPLE SOLE STRUCTURES AND ARTICLES OF FOOTWEAR ACCORDING TO THIS INVENTION

Referring to the figures and following discussion, various sole structures, articles of footwear, and features thereof in accordance with the present invention are disclosed. The sole structures and footwear depicted and discussed are athletic shoes, and the concepts disclosed with respect to various aspects of this footwear may be applied to a wide range of athletic footwear styles, including, but not limited to: walking shoes, tennis shoes, soccer shoes, football shoes, basketball shoes, running shoes, cross-training shoes, cleated shoes, golf shoes, etc. In addition, at least some concepts and aspects of the present invention may be applied to a wide range of non-athletic footwear, including work boots, sandals, loafers, and dress shoes. Accordingly, the present invention is not limited to the precise embodiments disclosed herein, but applies to footwear generally.

FIGS. 1A through 1D illustrate various views of an example article of footwear 100 that includes at least some aspects of this invention. For purposes of this disclosure, and as shown in FIG. 1A, portions of an article of footwear (and the various component parts thereof) may be identified based on regions of the foot located at or near that portion of the article of footwear. For example, as shown in FIG. 1A, an article of footwear may be considered as having a "forefoot region" at the front of the foot, a "midfoot" region at the middle or arch area of the foot, and a "heel region" at the rear of the foot. Footwear also includes a "lateral side" (the "outside" or "little toe side" of the foot) and a "medial side" (the "inside" or "big toe side" of the foot). The forefoot region generally includes portions of the footwear corresponding to the toes and the joints connecting the metatarsals with the phalanges. The midfoot region generally includes portions of the footwear corresponding with the arch area of the foot. The heel region generally corresponds with the rear portions of the foot, including the calcaneus bone. The lateral and medial sides of the footwear extend through the forefoot, midfoot, and heel regions and generally correspond with opposite sides of the footwear (and may be considered as being separated by the longitudinal axis, as shown in FIG. 1D). These regions and sides are not intended to demarcate precise areas of footwear. Rather, the terms "forefoot region," "midfoot region," "heel region," "lateral side," and "medial side" are intended to represent general areas of an article of footwear and the various components thereof to aid the in discussion that follows.

FIG. 1A shows a lateral side view of the article of footwear 100, FIG. 1B shows a medial side view, and FIG. 1C shows a bottom view. The article of footwear 100 includes an upper 102 engaged with a sole structure 104. Each of the upper 102 and the sole structure 104 may constitute multiple component parts that may be engaged together in any desired manner, including in conventional manners as are known and used in the footwear art, including through the use of cements or adhesives, through the use of mechanical connectors, and/or through fusing techniques (e.g., melt or fuse bonding of a hot melt material, etc.). The upper 102 and the sole structure 104 may be engaged with one another in any desired matter, including in conventional manners as are known and used in the footwear art, including through the use of cements or adhesives, through the use of mechanical connectors, and/or through fusing techniques (e.g., including melt or fuse bonding of hot melt materials, etc.). Examples of some construction techniques will be described in more detail below.

The upper 102 may be made from any desired materials and/or combination of materials without departing from this invention. In this illustrated example, the upper 102 includes a multi-layered construction, with the various layers covering all or some portion of the overall upper area. In some more specific examples, the upper 102 will include an intermediate mesh layer sandwiched in at least some areas by an interior fabric or textile layer (e.g., for comfortable contact with the foot) and an exterior "skin" layer 106 (e.g., made from a thermoplastic polyethylene film to provide better support at certain areas, to provide wear or abrasion resistance in certain areas, to provide desired aesthetics, etc.). None of the interior fabric or textile layer, the mesh layer, and/or the skin layer 106 needs to extend to cover an entire exterior surface of the upper 102. Rather, the location(s) of the various layers may be selected to control the properties of the upper, e.g., by omitting the skin layer 106 at certain areas to improve breathability, to improve flexibility, to provide a different aesthetic appearance (such as openings in the skin layer 106 to produce a "LOGO" or other design feature from the underlying mesh material 108, as shown in FIG. 1A), etc. Also, as shown in FIGS. 1A and 1B, the upper 102 may define an ankle opening 110, around which a comfort-enhancing foam or fabric ring 112 may be provided, if desired. The bottom surface of the upper may include an interior stroebel member that connects the medial and lateral sides (e.g., the stroebel member may be sewn to the medial and lateral side edges of the upper).

The multi-layered upper construction may be produced in any desired manner without departing from this invention, including in conventional manners as are known and used in the footwear art. For example, if desired, the skin layer 106 may be made from a "no-sew" type material that may be adhered to the underlying mesh layer 108 (or other layer) using an adhesive or hot melt material in a conventional manner, e.g., by application of heat and/or pressure. As additional examples, if desired, the skin layer 106 may be engaged with the underlying mesh layer 108 (or other layer) by cements or adhesives and/or by sewn seams. As yet additional examples, if desired, the upper 106 (or portions thereof) may be constructed by bonding various layers of materials using fusing techniques, e.g., as described in U.S. Patent Application Publication No. 2011/0088282 and U.S. Patent Application Publication No. 2011/0088285, each of which is entirely incorporated herein by reference.

The upper 102 may include other support elements at desired locations, e.g., sandwiched between the exterior skin layer 106 and the underlying mesh layer 108. For example, as shown in FIGS. 1A and 1B, a heel counter 114 may be provided in the heel area to provide more support for the wearer's heel. The heel counter 114 may be made from a rigid, thin plastic material, such as PEBAX, TPU, or other polymeric material, and it may include one or more openings (e.g., to control flexibility, breathability, support characteristics; to reduce weight; etc.). If necessary or desired, additional supports may be provided in other areas of the shoe 100, such as in the forefoot or toe area (to provide protection and wear resistance, etc.), at the lateral side area near the fifth metatarsal head, etc. The skin material 106 may be thin and conformable enough and may be pressed into the underlying material(s) enough so that the outer surface of the skin material 106 conforms to the surface characteristics of the underlying layers. In this manner, if desired, the texture of the exterior surfaces of the underlying mesh layer 108, the heel counter 114, and/or any other underlying material or structure may be visible through the skin layer 106.

The sole structure 104 of this example article of footwear 100 now will be described in more detail. As shown in FIGS. 1A through 1C, this example sole structure 104 includes a single midsole component 118 that extends in this particular structure 104 to support a complete plantar surface of a foot of a wearer, i.e., from the rear heel area of the shoe 100 to the front toe area of the shoe 100 and from the lateral side edge (FIG. 1A) to the medial side edge (FIG. 1B) of the shoe 100. While other midsole constructions are possible, in accordance with some examples of this invention, the midsole component 118 may constitute a foam material (such as ethylvinylacetate ("EVA") foam, polyurethane foam, phylon foam, and phylite foam). In some more specific examples of this invention, the midsole component 118 will be at least partially made from a foam material having a density of less than 0.25 g/cm$^3$ (and in some examples, a density of less than 0.2 g/cm$^3$, within the range of 0.075 to 0.2 g/cm$^3$, and even within the range of 0.1 to 0.18 g/cm$^3$). If desired, the foam material may include one or more openings defined therein and/or another impact-force attenuating component included with it, such as a fluid-filled bladder. In certain embodiments of this invention, the entire midsole component 118 will constitute this lightweight foam material (e.g., with a density feature as described above) and will extend to support the complete foot of the wearer (e.g., the complete plantar surface). In the example of FIGS. 1A through 1C, the foam midsole component 118 is illustrated with dashed-line hatching. Alternatively, the midsole component 118 may be made from multiple component midsole (e.g., foam) parts, if desired.

As some even more specific examples, at least some of the midsole component 118 may be made from a foam material as described, for example, in U.S. Pat. No. 7,941,938, which patent is entirely incorporated herein by reference. In at least some example footwear structures 100 according to this invention, all, substantially all, or at least some portion of the midsole component 118 may include a foam material comprising a reaction product of about 10 to about 100 parts per hundred hydrogenated or non-hydrogenated acrylonitrile butadiene copolymer, 0 to about 40 parts per hundred modified hydrogenated acrylonitrile butadiene copolymer, and 0 to about 90 parts per hundred alpha olefin copolymer, and at least one additive in an amount suitable to form the foam material. This foam material may have a lightweight, spongy feel. The density of the foam material may be generally less than 0.25 g/cm$^3$, less than 0.20 g/cm$^3$, less than 18 g/cm$^3$, less than 0.15 g/cm$^3$, less than 0.12 g/cm$^3$, and in one aspect, about 0.10 g/cm$^3$. As example ranges, the foam density may fall within the range, for example, of 0.05 to 0.25 g/cm$^3$ or within the various ranges noted above.

Also, in accordance with at least some examples of this invention, the resiliency of the foam material for the midsole component 118 may be greater than 40%, greater than 45%, at least 50%, and in one aspect from 50-70%. Compression set may be 60% or less, 50% or less, 45% or less, and in some instances, within the range of 20 to 60%. The hardness (Durometer Asker C) of the foam material for this example midsole component 118 may be, for example, 25 to 50, 25 to 45, 25 to 35, or 35 to 45, e.g., depending on the type of footwear. The tensile strength of the foam material 118 may be at least 15 kg/cm$^2$, and typically 15 to 40 kg/cm$^2$. The elongation % is 150 to 500, typically above 250. The tear strength is 6-15 kg/cm, typically above 7. In at least some example constructions according to the invention, the foam material of at least some portion of the midsole component 118 may have lower energy loss and may be more lightweight than traditional EVA foams. The energy loss may be less than 30%, and optionally within the range of about 20% to about 30%. As additional examples, if desired, at least some portion of the midsole component 118 may be made from foam materials used in the LUNAR family of footwear products available from NIKE, Inc. of Beaverton, Oreg.

While the above paragraphs describe potential properties and features of foam materials for midsole components 118 in accordance with some examples of this invention, those skilled in the art will recognize that the midsole component 118 may have other desired properties, features, and/or combinations of features without departing from this invention. Other lightweight foams also may be used. Because of the cage components described in more detail below, the lightweight foam midsole component 118 need not necessarily have sufficient hardness, durability, and/or abrasion resistance to contact the ground in use.

FIGS. 1A through 1C further show that the midsole component 118 is partially covered in various areas by a plurality of "cage components." These cage components protect the lightweight foam midsole material 118 and provide the necessary degree of hardness, durability, and/or abrasion resistance for engaging the ground. Four cage components are shown in the example structure of FIGS. 1A through 1C, namely: (a) a rear heel cage component 120*a* (covering a portion of a rear heel area of the foam midsole component 118); (b) a forward heel cage component 120*b* (covering a portion of a forward heel area of the foam midsole component 118); (c) a midfoot cage component 120*c* (covering a portion of a midfoot area of the foam midsole component 118); and (d) a forefoot cage component 120*d* (covering a portion of a forefoot area of the foam midsole component 118). As best shown in FIG. 1C, each of these example cage components 120*a*, 120*b*, 120*c*, and 120*d* includes portions that extend in a continuous or uninterrupted manner from a lateral side (outside) of the sole structure 104 to a medial side (inside) of the sole structure 104. While the cage components 120*a*, 120*b*, 120*c*, and 120*d* may be made from any desired materials and/or have any desired properties without departing from this invention, in some example shoe structures 100 according to this invention, the cage components 120*a*, 120*b*, 120*c*, and 120*d* may be made from the same or different materials, and optionally, each may be made, at least in part, from one or more materials selected from the group consisting of: ethylvinylacetate foam, polyurethane foam, phylon foam, a phylite material, and a rubber material. In some examples of this invention, the cage components 120*a*, 120*b*, 120*c*, and 120*d* may be made, at least in part, from a foam material having a density higher than the density of the foam material of the midsole component 118 (and, as some more specific examples, from an ethylvinylacetate foam material, a polyurethane foam material, and/or a phylon foam material having a density greater than 0.2 g/cm$^3$, and in some examples, a density of greater than 0.25 g/cm$^3$, and/or from a material like the shell material described in U.S. Pat. No. 7,941,938). The material of a cage component at one location may differ from that at another location (e.g., in density, hardness, abrasion resistance, color, thickness, etc.) to provide desired properties at desired locations. The cage components may be located around the sole structure 104 so as to act as primary ground contact elements for the sole structure 104.

If desired, in accordance with at least some examples of this invention, the cage components 120*a*, 120*b*, 120*c*, and 120*d* may be sized, shaped, and oriented so as to provide more natural flexion and motion to the footwear and/or the overall sole structure 104 (e.g., to facilitate flex of the sole structure 104 in a manner to more closely correspond to the natural motion of a foot). For example, as shown in FIG. 1C, a space 122 is provided between the rear heel cage component 120*a* and the forward heel cage component 120*b* such that an exterior surface of the foam midsole component 118 (both bottom and side surfaces thereof) may be exposed at the space 122. Similarly, a space 124 exists between the forward heel cage component 120*b* and the midfoot cage component 120*c* such that the exterior surface of the foam midsole component 118 (both its bottom and side surfaces) may be exposed at this space 124. A third space 126 exists between the midfoot cage component 120*c* and the forefoot cage component 120, and the exterior surface of the foam midsole component 118 (both its bottom and side surfaces) may be exposed at this space 126. The spaces 122, 124, and 126 include at least some portions extending continuously (and uninterrupted) in a substantially transverse direction from the medial side to the lateral side of the sole structure 104. In this manner, the spaces 122, 124, and 126 provide a substantially transverse flexion line between the cage components that define the space. The transverse directional extension of these spaces 122, 124, and 126 in the illustrated examples are provided at locations corresponding to natural flexion areas of the foot, e.g., during a normal walking or running step cycle. Additionally, in this illustrated example 100, the forefoot cage component 120*d* includes a thinned or recessed transverse region 128 that also functions as a flexion line for the forefoot region of the sole structure 104. Alternatively, if desired, all or some portion of the thinned or recessed transverse region 128 of forefoot cage component 120*d* could be eliminated to thereby expose the midsole component 118 and divide the forefoot cage component 120 into two (or more) separate cage pieces.

The spaces 122, 124, and/or 126 between adjacent cage components 120*a*, 120*b*, 120*c*, and/or 120*d* are not limited to relatively narrow, linear spaces defining flexion lines. For example, as shown in FIG. 1C, cage components 120*a* and 120*b* have generally U-shaped perimeters such that the intermediate portion of space 122 is substantially larger than a narrow linear segment. Rather, as shown in FIG. 1C, the relatively close space 122 between the cage components 120*a* and 120*b* opens or morphs into a large open area 122*a* in which the bottom of the midsole component 118 is exposed. In this illustrated example, the exterior surface of the foam midsole component 118 exposed in the first space 122 has a greater maximum or overall length dimension L in a longitudinal direction of the article of footwear and/or the sole structure than a maximum or overall width dimension W in a transverse direction of the article of footwear and/or the sole structure. See FIG. 1D. In contrast, in this illustrated example, the exterior surface 124*a* of the foam midsole component 118 exposed in the second space 124 has a greater maximum or overall width dimension in the transverse direction of the article of footwear and/or sole structure than a maximum or overall length dimension in a longitudinal direction of the article of footwear and/or the sole structure. Also, the exterior surface 126*a* of the foam midsole component 118 exposed in the third space 126 includes a substantially U-shaped perimeter P (FIG. 1D).

The cage components 120*a* through 120*d* may be engaged with the foam midsole component 118 (and/or any other portion of the footwear structure 100) in any desired manner without departing from this invention, including in conventional manners as are known and used in the art. As some more specific examples, if desired, the foam midsole component 118 may be molded (e.g., by injection molding, compression molding, blow molding, etc.) to include recesses shaped like the interfacing surface of the cage components 120*a* through 120*d* so that the cage components 120*a* through 120*d* fit within and become engaged in the recesses, e.g., by cements or adhesives, by mechanical connectors, by fusing techniques, etc. The cage components 120*a* through 120*d* also may be formed by molding processes, e.g., like those mentioned above. The various parts may be appropriately shaped so that at least some portions of the exposed bottom and/or side surfaces of the midsole component 118 is recessed in the overall sole structure 104 with respect to adjacent bottom and/or side surfaces of the cage components 120*a* through 120*d* (so that the cage components 120*a* through 120*d* have increased interaction with the ground as compared to the midsole component 118). At least some portions of the bottom surfaces 122*a*, 124*a*, and 126*a* may be recessed from the bottom surfaces of the adjacent cage components 120*a* through 120*d*. Additional recesses formed in the bottom surface 126*a* of the midsole component 118 also may be located to provide thinned midsole regions at selected areas to better support flexion in the generally longitudinal and/or transverse directions (e.g., between adjacent outsole components to be described in more detail below).

In addition to providing flexion advantages, providing the exterior protective cage as separated or compartmentalized cage components results in significant weight savings for an overall sole structure (as compared to a cage component completely covering midsole component 118), while still providing an adequately durable, strong, and abrasion resistant sole structure 104. In this illustrated structure, the midsole component 118 is sufficiently covered by the cage components at areas of stress and wear to enhance the useful life of the sole structure and remains exposed and/or recessed, e.g., at areas typically exposed to less stress and/or wear.

Additional features may be provided to enhance wear resistance and traction. In this illustrated structure 100, the bottom surface of sole structure 104 includes a plurality of separated outsole components designed to directly contact the ground or other contact surface in use. While any desired number, shape, and/or positioning of outsole components may be used without departing from this invention, this illustrated example sole structure 104 includes seven outsole components mounted on the cage components 120*a* through 120*d*, namely: (a) a rear heel outsole component 130*a* (which, in this example, extends around the rear heel from the lateral side to the medial side); (b) a forward, lateral heel outsole component 130*b*; (c) a lateral midfoot outsole component 130*c*; (d) a medial midfoot outsole component 130*d*; (f) a lateral forefoot outsole component 130*e*; (f) a medial forefoot outsole component 130*f*; and (g) a front forefoot outsole component 130*g* (which, in this example, extends around the toe area from the lateral side to the medial side). These outsole components are relatively thin disk or plate like members engaged in recesses or other structures molded into the outer surfaces of the cage components with which they are engaged.

If desired, additional outsole components may be provided, e.g., directly on the exposed exterior surface of the midsole component 118. This is shown in the example sole structure 104 of FIG. 1C by outsole components 130*h*, 130*i*, 130*j*, and 130*k* provided on surface 126*a* of space 126 (e.g., on raised areas and/or compartments of midsole component 118 within space 126).

The outsole components 130*a* through 130*k* are shown in FIG. 1C by hatching extending only in the generally transverse direction. This hatching also may be considered as representing any desired type of traction enhancing structure, pattern, or configuration, including, for example, raised ridges, recessed grooves, gaps, cleats, nubs, pyramids, truncated pyramids, cones, truncated cones, or other traction elements. More or fewer outsole components may be included in the sole structure 104 without departing from this invention, and/or if desired, some of the identified outsole components may be combined into a single outsole component.

Any desired material may be used for outsole components 130*a* through 130*k* without departing from this invention, including outsole materials as are conventionally known and used in the art. Examples include: rubber containing materials, thermoplastic polyurethane containing materials, phylon, phylite, other plastics, etc. The outsole components 130*a* through 130*k* may be made by any desired method, including molding methods, as are conventionally known and used in the art. The outsole components 130*a* through 130*k* may be shaped to fit within recessed areas or receptacles formed (e.g., molded) into the outer surface of the cage components 120*a* through 120*d* and/or the midsole component 118 and may be secured thereto in any desired, manner, including with cements or adhesives, mechanical connectors, fusing techniques, etc. The outsole components 130*a* through 130*k* may have any desired thickness, e.g., from about ⅛ inch to about ½ inch.

Some exposed areas of the bottom surface of the cage components 120*a* through 120*d* may include surface that may contact the ground without an outsole element engaged with it. Examples of such areas are shown as areas 132*a*, 132*b*, and 132*c* in FIGS. 1A through 1C (and identified by crossed transverse and longitudinal hatching in FIG. 1C). These areas 132*a* through 132*c* may have an adequate height to engage the ground, but may receive less wear (and thus not need the additional protection of an outsole component as much). If desired, the exposed surfaces of areas 132*a*, 132*b*, and 132*c* may include traction elements, e.g., of the various types described above. Alternatively, if desired, these areas may be treated in other manners to increase hardness, abrasion resistance, wear resistance, etc., e.g., by coating or impregnating the foam material with a hardening agent, etc.

In this illustrated example structure 104, area 132*a* is located on the lateral, forward heel area of the sole structure 104 and area 132*b* is located on the medial, forward heel area of the sole structure 104. In a step cycle, a user typically lands on the rear, lateral heel of the shoe, and as the step progresses, the weight shifts forward and toward the medial side of the foot. Therefore, areas 132*a* and 132*b* may receive less impact force and/or support less weight than other areas of the foot during a step cycle and/or may be adequately protected from excessive wear by adjacent outsole components 130*a* and 130*b*. The absence of outsole components at these areas 132*a* and 132*b* also may provide a somewhat softer and more comfortable overall ground contact feel. Area 132*c* also may be adequately protected from excessive wear by the surrounding portions of outsole component 130*g* (note how outsole component 130*g* partially surrounds (e.g., on three sides) exposed forefoot cage area 132*c*). The lack of an outsole component at area 132*c* provides a comfortable, softer feel for the push-off or toe-off phase of the step cycle, as area 132*c* is located beneath the big toe, which typically is used to propel the foot into the next step. Fewer outsole components also typically will reduce sole structure weight.

While one example arrangement is shown in FIGS. 1A through 1C, those skilled in the art will recognize that the various cage components, outsole components, and/or exposed bottom midsole areas may vary widely in size, shape, orientation, arrangement, and/or number without departing from this invention.

FIGS. 1A and 1B show another feature that may be included in sole structures 104 in accordance with at least some examples of this invention. As shown in these figures, at least some portion of the outer edges or sides of the various cage components 120*a* through 120*d* may include a "billowed structure" 134. The term "billowed structure," as used herein, means that the exterior surface shape of the element has the exterior surface shape of a billow, e.g., a wave like structure with a series of wave peaks (the outermost portion) and valleys between the wave peaks. In a sole structure, a "billowed structure" need not expand and compress in the same manner of a conventional billow. In the illustrated example 104, each of cage components 120*a* through 120*d* has a series of two billows 134 (e.g., appearing like two stacked disks). These billows 134 are positioned such that a topmost billow 134 of the cage components 120*a* through 120*d* lies adjacent an additional billowed structure 136 provided along an upper edge of the foam midsole component 118 (optionally, to give the appearance of an overall consistent billows structure in the top-to-bottom direction).

The size, number, shape, and/or other features of the billowed structure 134 may be selected to control the feel of the article of footwear. Typically, a deeper billow (i.e., a greater dimension from a wave crest to the bottom of an adjacent trough) will provide a more responsive feel (e.g., quicker return to original shape). The size, density, and/or hardness of the midsole component 118 and/or the cage components 120*a* through 120*d* also may be controlled so as to enable control over the feel of the sole structure 104 to a wearer's foot.

Figure 2A:
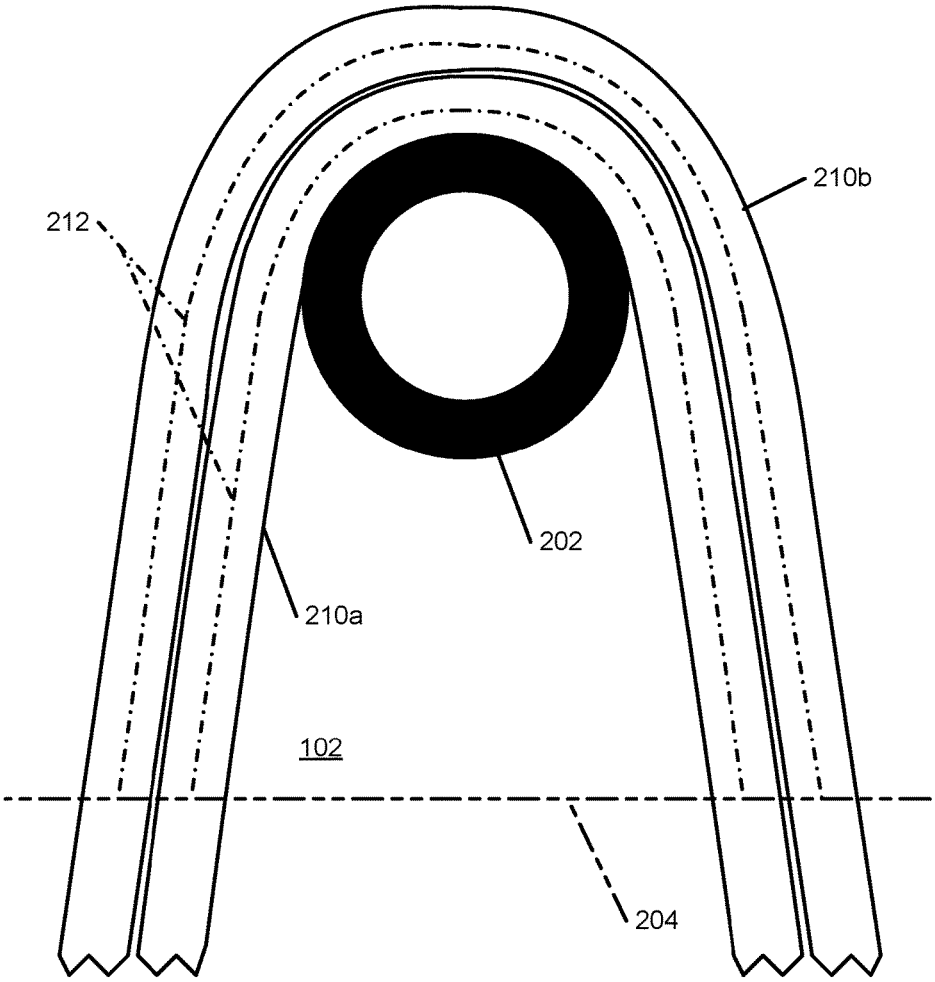
FIGS. 2A and 2B show various examples of elongated wire or textile components used as lace receiving opening or eyelet support components in accordance with at least some aspects of this invention.
Figure 2B:
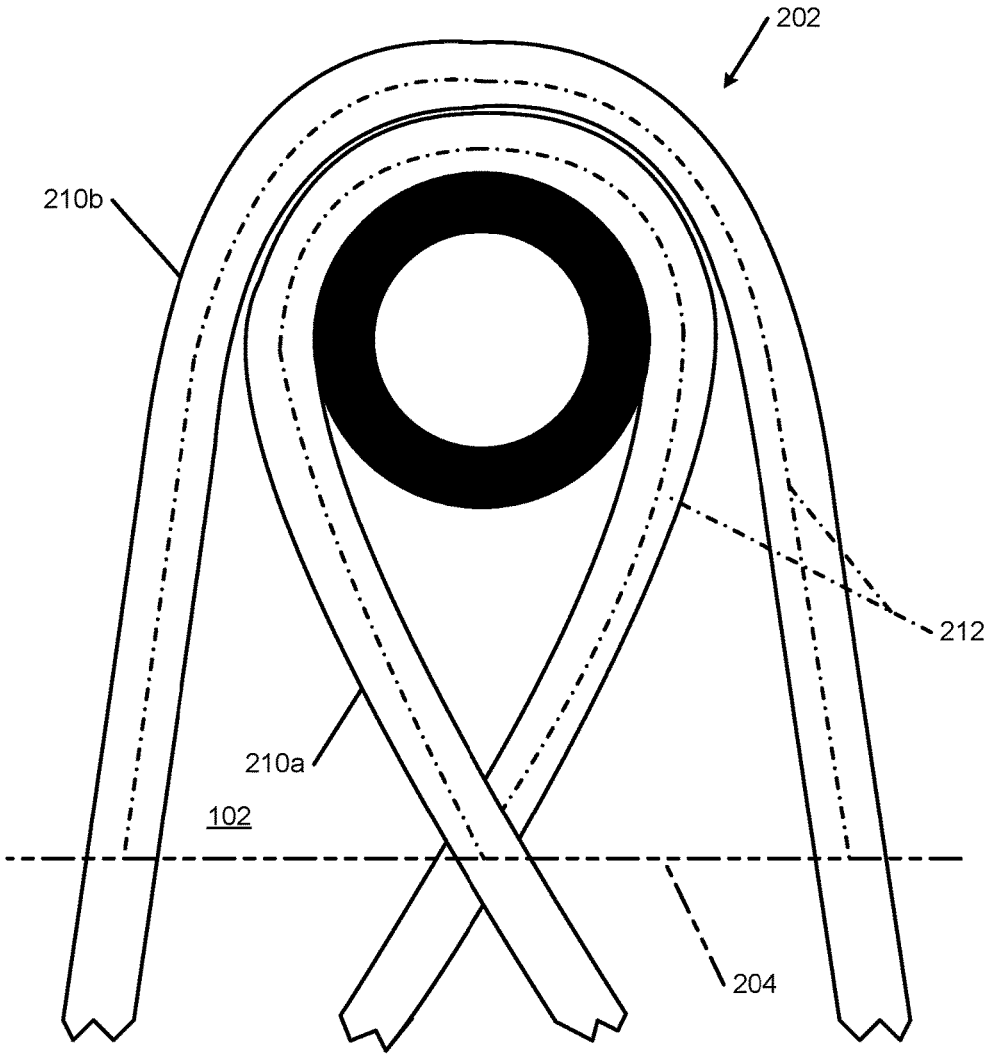

While any desired type of upper 102 may be included in the footwear structure described above, FIGS. 1A and 1B, together with FIGS. 2A and 2B, provide additional details regarding a portion of an upper construction 102 that may be included in articles of footwear 100 in accordance with at least some examples of this invention. As shown in FIGS. 1A and 1B, upper 102 includes an instep opening having a plurality of lace engaging elements 202 on both the lateral and medial sides of the instep opening. These lace engaging elements 202 may be holes in the material of the upper, optionally reinforced by metal or plastic eyelets and/or a tear resistant support material 204 (which may constitute another layer of upper material (around the lace engaging area 202, as shown in FIGS. 1A and 1B)). In this illustrated example, tear resistant support material 204 constitutes an additional layer of upper material fused (e.g., hot melt bonded) or adhesively bonded to the exterior of a mesh material 108 making up the upper member 102 at the identified location. As is conventional, a tongue member 206 may be provided to help modulate the pressure and feel of the lace 208 when the lace 208 is tightened on a wearer's foot. The tongue member 206 may be engaged with the upper 102 by sewing (e.g., see stitch line 240), by fusing techniques, etc., and/or it may be formed as an integral piece with some other portion of the upper 102. Additionally or alternatively, if desired, an interior bootie element may be provided within the footwear interior, and this bootie element may at least partially modulate the pressure and feel associated with the tightened lace 208.

While also shown in FIGS. 1A and 1B, FIG. 2A provides an enlarged view of the area around an individual lace engaging element 202. To further support the laces and to provide a close, snug fit around the wearer's foot (e.g., a wrap around fit), as shown in these figures, on each of the lateral and medial sides of the shoe, at least one of the lace engaging elements 202 includes at least one elongated wire or textile component 210*a* that loops around the lace engaging element 202. In the illustrated example, several of the lace engaging elements 202 (eyelets) include two individual elongated wire or textile components (210*a* and 210*b*) that loop around the lace engaging element 202 to support the upper material and the lace 208. Any desired number of elongated wire or textile components may be provided around an individual lace engaging element 202 without departing from this invention (e.g., from one to four).

FIG. 2B shows a view similar to that of FIG. 2A, except in the structure shown in FIG. 2B, the inner elongated wire or textile component 210*a* crosses itself below the lace engaging element 202 and also wraps around the top of that lace engaging element 202. Additionally or alternatively, if desired, the outer elongated wire or textile component 210*b* may cross in the same manner. As still additional alternatives, if desired, the elongated wire or textile components 210*a* and/or 210*b* may loop around the lace engaging element 202 multiple times. As yet another alternative, if desired, an elongated wire or textile component could extend around two or more adjacent lace engaging elements 202 on one side of the shoe (e.g., so that the elongated wire or textile component extends around a first side of a first lace engaging element, along the upper to the next adjacent lace engaging element, and around the opposite side of that next adjacent lace engaging element (or a lace engaging element further down the line)). A variety of manners of arranging the elongated wire or textile components on the upper and/or around the lace engaging elements 202 may be used without departing from this invention.

The elongated wire or textile elements 210*a* and/or 210*b* may be made from any desired materials, including one-dimensional strands of material that can withstand tensile forces and resist stretch in the tensile force direction (at least with respect to the tensile forces expected in this environment). As utilized with respect to the present disclosure, the term "one-dimensional" material (or variants thereof) is intended to encompass generally elongate materials exhibiting a length that is substantially greater than a width and a thickness. Accordingly, suitable materials for the elongated wire or textile elements set forth herein include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Whereas filaments have an indefinite length and may be utilized individually as strands according to embodiments set forth herein, fibers have a relatively short length and generally go through spinning or twisting processes to produce a strand of suitable length. An individual filament utilized for tensile strands as set forth herein may be formed form a single material (i.e., a monocomponent filament) or from multiple materials (e.g., a bicomponent filament). Similarly, different filaments may be formed from different materials. As an example, yarns utilized for the tensile strands may include filaments that are each formed from a common material, may include filaments that are each formed from two or more different materials, or may include filaments that are each formed from two or more different materials. Similar concepts also apply to threads, cables, or ropes. The thickness (e.g., diameter) of each of the elongated wire or textile elements may also vary significantly, e.g., to range from 0.03 millimeters to 5 millimeters or more, for example. The elongated wire or textile elements 210*a* and/or 210*b* may take on any of the sizes, shapes, and/or constructions, e.g., as disclosed in U.S. patent application Ser. No. 13/529,381, filed Jun. 21, 2012, and entitled "FOOTWEAR INCORPORATING LOOPED TENSILE STRAND ELEMENTS," the disclosure of which is entirely incorporated herein by reference.

The elongated wire or textile components 210*a* and 210*b* may be engaged with and/or incorporated into the upper 102 in any desired manner without departing from this invention, including in the various manners disclosed in U.S. patent application Ser. No. 13/529,381 mentioned above. As some more specific examples, the elongated wire or textile components 210*a* and 210*b* may be engaged with the tear resistant support material 204 provided with the upper 102 by embroidery, by sewing or stitching, or the like. In the illustrated example, as shown in FIG. 2A, the elongated wire or textile components 210*a* and 210*b* are engaged with the upper 102 at the area including the tear resistant support material 204 by one or more embroidered or stitched lines 212. In this illustrated embodiment, at least some of the elongated wire or textile components 210*a* and/or 210*b* that loop around the lace receiving openings or eyelets 202 (and optionally all of these components) include a first portion (on the tear resistant support material 204, in this example) that is fixed to an exterior surface of the upper 102 and a second portion (below the tear resistant support material 204) that is not fixed to the exterior surface of the upper 102. Thus, the elongated wire or textile components 210*a* and 210*b* may freely separate from the upper 102 at locations below the tear resistant support material 204, in this illustrated example structure.

In the illustrated examples, the elongated wire or textile component 210*a* is completely contained within the space or area defined by elongated wire or textile component 210*b*. Other arrangements are possible, e.g., in which elongated wire or textile components 210*a* and 210*b* cross each other. Also, in these illustrated examples, each lace engaging element 202 that has an elongated wire or textile component associated with it includes a pair of elongated wire or textile components 210*a* and 210*b*. This also is not a requirement. Different lace engaging elements may include different numbers and/or arrangements of elongated wire or textile components without departing from this invention. Some lace engaging elements 202 may have no associated wire or textile components, if desired. Also, if desired, elongated wire or textile components 210*a* and 210*b* associated with one lace engaging element 202 may cross over one or more of the elongated wire or textile components 210*a* and/or 210*b* associated with other lace engaging elements 202 (e.g., an immediately adjacent lace engaging element 202). A wide variety of specific arrangements and orientations of elongated wire or textile components are possible without departing from this invention. The arrangement, color, and/or other features of the elongated wire or textile components (e.g., crossing, overlapping, etc.) may be selected to produce a desired aesthetic appearance as well.

FIGS. 1A and 1B illustrate additional features of the elongated wire or textile elements 210*a* and 210*b* that may be included in upper structures 102 in accordance with at least some examples of this invention. As shown in these figures, at least some of the elongated wire or textile components 210*a* and 210*b* may include: (a) a first end located between the upper 102 and an upper surface of the foam midsole component 118, (b) a second end located between the upper 102 and the upper surface of the foam midsole component 118, and (c) an intermediate portion between the first end and the second end that loops around the lace support member 202 (e.g., an opening or eyelet). In this illustrated example, areas of the elongated wire or textile components 210*a* and 210*b* near their ends (e.g., near the foam midsole component 118) may be covered by the skin layer 106.

In production, the elongated wire or textile components 210*a* and/or 210*b* may be: (a) engaged at their intermediate portion around the lace support members 202 (e.g., by embroidery, stitching, sewing, etc.), (b) stretched or tightened at least somewhat (e.g., to eliminate excess slack), and then (c) fixed between the mesh material 108 and skin material 106 of the upper, e.g., by adhesives or cements, by fuse bonding techniques, etc. Once the upper is produced, it may be engaged around a last such that the elongated wire or textile components 210*a* and/or 210*b* wrap around the sides of the last to a location underneath the last. The elongated wire or textile component(s) may be engaged around the outside of any stroebel member included as part of the upper structure 102. The elongated wire or textile components 210*a* and/or 210*b* then may be fixed between the upper 102 and the top surface of the midsole component 118, e.g., by cements or adhesives. Other structures, techniques, and/or ordering of steps are possible without departing from this invention. As another potential alternative, if desired, the elongated wire or textile components 210*a* and/or 210*b* may extend completely across the bottom surface of the upper such that a single elongated wire or textile components 210*a* and/or 210*b* loops around one or more lace engaging supports 202 on both the medial and lateral sides of the shoe. Thus, at least some of the elongated wire or textile components may constitute a continuous loop that extends around lace receiving elements 202 on both sides of the upper to wrap around the wearer's foot, if desired.

By extending at least partially beneath the plantar surface of the foot, the elongated wire or textile components 210*a* and/or 210*b* help wrap the upper around the foot as the lace 208 is pulled and tightened, to thereby provide a close, snug, and supportive fit around the foot. Alternatively, if desired, the elongated wire or textile components 210*a* and/or 210*b* may be omitted and/or other upper constructions 102 can be used with the sole structure 104 described above without departing from this invention.

As mentioned above, if desired, other arrangements of the elongated wire or textile components 210*a* and/or 210*b* may be provided in an upper structure 102 without departing from this invention. FIG. 2B shows an arrangement in which the inner elongated wire or textile component 210*a* crosses itself at a location below the lace support component 202. If desired, this component 210*a* may cross itself multiple times and/or it may cross with elongated wire or textile component 210*b* (or with one or more adjacent elongated wire or textile components 210*a* and/or 210*b*). Likewise, if desired, elongated wire or textile component 210*b* may cross itself at a location below the lace support component 202 one or more times and/or it may cross with elongated wire or textile components 210*a* and/or 210*b* of adjacent lace support structures 202.

Figure 3:
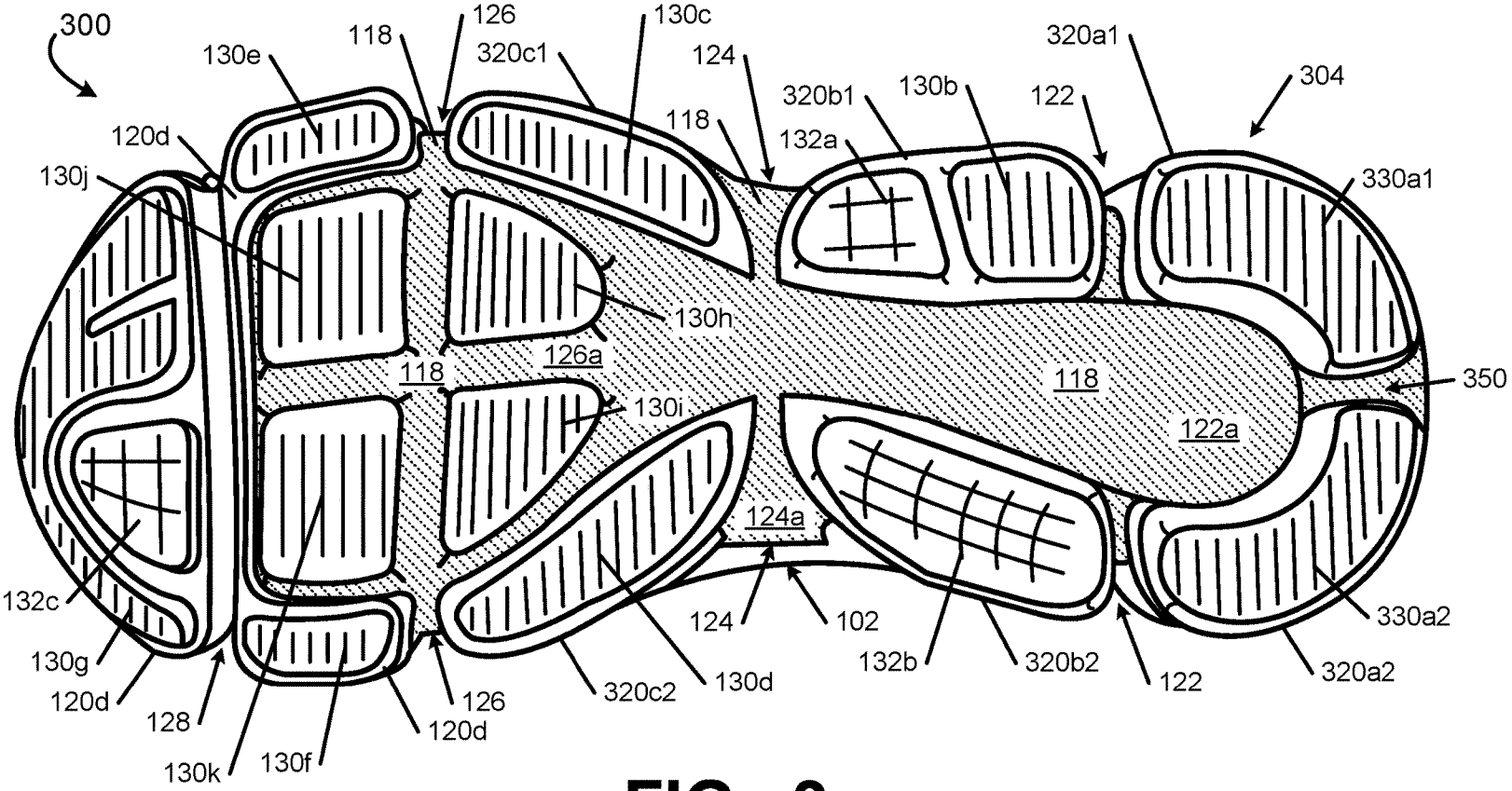
FIG. 3 illustrates a bottom view of another example sole structure in accordance with this invention.

FIG. 3 includes a bottom view of an article of footwear 300 similar to that shown in FIG. 1C, but with another example sole structure 304. Where FIG. 3 includes reference numbers the same as those shown in FIG. 1C, the same or similar parts are intended, and a detailed description thereof may be omitted (or at least abbreviated).

One main difference between the sole structure 104 shown in FIG. 1C and the sole structure 304 shown in FIG. 3 is that the sole structure 304 of FIG. 3 includes features to further increase relative flexibility in the longitudinal direction (i.e., flexibility of the medial and lateral sides of the sole structure 304 with respect to one another). This improved lateral side-to-medial side flexibility is accomplished by splitting up one or more of the cage components, e.g., by eliminating at least some of the cage material in the longitudinal direction at and/or near an area along the longitudinal axis of the shoe 300 and sole structure 304.

As a more specific example, as shown in FIG. 3, instead of a single rear heel cage component 120*a*, in the structure of FIG. 3, the rear heel cage component includes a lateral side rear heel cage component 320*a*1 covering a lateral rear heel area of the foam midsole component 118 and a medial side rear heel cage component 320*a*2 covering a medial rear heel area of the foam midsole component 118. The rear heel outsole component also is split into two parts in this illustrated example structure 304, namely, outsole components 330*a*1 and 330*a*2 shown in FIG. 3. These features leave a gap 350 at the extreme rear heel area in which the exterior surface of the foam midsole component 118 is exposed. This gap 350 helps provide improved flexibility of the sole structure 304 in the generally longitudinal direction at the heel area.

Additionally or alternatively, as further shown in FIG. 3, the forward heel cage component of this illustrated structure 304 also is provided in two parts, namely: a lateral forward heel cage component 320*b*1 (which covers a lateral forward heel portion of the foam midsole component 118) and a medial forward heel cage component 320*b*2 (which covers a medial forward heel portion of the midsole component 118). This structure leaves a relatively large central heel portion of the midsole component 118 exposed between the inner sides of the forward heel cage components 320*b*1 and 320*b*2.

As another additional or alternative feature, in this illustrated example sole structure 304, the midfoot cage component also is provided in two parts, namely: a lateral midfoot cage component 320*c*1 (which covers a lateral midfoot portion of the foam midsole component 118) and a medial midfoot cage component 320*c*2 (which covers a medial midfoot portion of the midsole component 118). This structure leaves a relatively large central midfoot portion of the midsole component 118 exposed between the inner sides of the midfoot cage components 320*c*1 and 320*c*2. The combined effect of the separated forward heel cage components 320*b*1, 320*b*2 and midfoot cage components 320*c*1, 320*c*2, as shown in FIG. 3, is that in this example structure 304, a large central portion of the midsole component 118 is exposed, extending continuously from the rear heel region to the forefoot region.

While not shown in the structure of FIG. 3, if desired, as an additional or alternative feature, the forefoot cage component 120*d* also could be made of multiple independent parts, optionally with the division between the parts provided in generally the longitudinal direction and/or the transverse direction (e.g., replacing thinned area 128).

In addition to increasing longitudinal flexibility (e.g., during a step cycle as the weight shifts from the lateral side of the foot to the medial side of the foot), the sole structure 304 of FIG. 3 may be somewhat lighter than the structure of FIG. 1C, due to reduction in the amount of cage component material and/or outsole component material. While it may have the same upper 102 and/or upper characteristics of the various types described above in conjunction with FIGS. 1A through 2B, any other desired upper construction also could be used with sole structure 304 without departing from this invention.

III. CONCLUSION

The present invention is disclosed above and in the accompanying drawings with reference to a variety of embodiments. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. An article of footwear, comprising:

an upper; and a sole structure engaged with the upper, the sole structure including:

a foam midsole component formed from a foam material having a density of less than 0.25 g/cm$^3$ extending from a heel region to a forefoot region; and a plurality of cage components, each cage component distinct from the foam midsole component and covering side and bottom regions of an area of the foam midsole component, wherein at least one space exists between adjacent cage components of the plurality of cage components, and wherein an exterior surface of the foam material of the foam midsole component spans the at least one space between the adjacent cage components and is exposed in the at least one space between adjacent cage components.

2. The article of footwear according to claim 1, wherein the upper includes an instep opening including a plurality of lateral lace support elements on a lateral side of the instep opening and a plurality of medial lace support elements on a medial side of the instep opening.

3. The article of footwear according to claim 2, wherein at least one of the lateral lace support elements includes an elongated wire or textile component that loops around a lateral side lace receiving opening or eyelet, and wherein at least one of the medial lace support elements includes an elongated wire or textile component that loops around a medial side lace receiving opening or eyelet.

4. The article of footwear according to claim 3, wherein a portion of the elongated wire or textile component that loops around the lateral side lace receiving opening or eyelet includes a first portion adjacent the lateral side lace receiving opening or eyelet that is fixed to an exterior surface of the upper and a second portion that is not fixed to the exterior surface of the upper, and wherein a portion of the elongated wire or textile component that loops around the medial side lace receiving opening or eyelet includes a first portion adjacent the medial side lace receiving opening or eyelet that is fixed to the exterior surface of the upper and a second portion that is not fixed to the exterior surface of the upper.

5. The article of footwear according to claim 2, wherein at least one of the lateral lace support elements includes: (a) a first elongated wire or textile component that loops around a first lateral side lace receiving opening or eyelet and (b) a second elongated wire or textile component that loops around the first lateral side lace receiving opening or eyelet, and wherein at least one of the medial lace support elements includes: (a) a third elongated wire or textile component that loops around a first medial side lace receiving opening or eyelet and (b) a fourth elongated wire or textile component that loops around the first medial side lace receiving opening or eyelet.

6. The article of footwear according to claim 5, wherein:

the first elongated wire or textile component includes: (a) a first end located between the upper and an upper surface of the foam midsole component, (b) a second end located between the upper and the upper surface of the foam midsole component, and (c) an intermediate portion between the first and second ends of the first elongated wire or textile component that loops around the first lateral side lace receiving opening or eyelet, the second elongated wire or textile component includes: (a) a first end located between the upper and the upper surface of the foam midsole component, (b) a second end located between the upper and the upper surface of the foam midsole component, and (c) an intermediate portion between the first and second ends of the second elongated wire or textile component that loops around the first lateral side lace receiving opening or eyelet, the third elongated wire or textile component includes: (a) a first end located between the upper and the upper surface of the foam midsole component, (b) a second end located between the upper and the upper surface of the foam midsole component, and (c) an intermediate portion between the first and second ends of the third elongated wire or textile component that loops around the first medial side lace receiving opening or eyelet, and the fourth elongated wire or textile component includes: (a) a first end located between the upper and the upper surface of the foam midsole component, (b) a second end located between the upper and the upper surface of the foam midsole component, and (c) an intermediate portion between the first and second ends of the fourth elongated wire or textile component that loops around the first medial side lace receiving opening or eyelet.

7. The article of footwear according to claim 2, wherein each of the plurality of the lateral lace support elements includes: (a) a first elongated wire or textile component that loops around a corresponding lateral side lace receiving opening or eyelet and (b) a second elongated wire or textile component that loops around the corresponding lateral side lace receiving opening or eyelet, and wherein each of the plurality of the medial lace support elements includes: (a) a third elongated wire or textile component that loops around a corresponding medial side lace receiving opening or eyelet and (b) a fourth elongated wire or textile component that loops around the corresponding medial side lace receiving opening or eyelet.

8. The article of footwear according to claim 7, wherein:

each of the first elongated wire or textile components includes: (a) a first end located between the upper and an upper surface of the foam midsole component, (b) a second end located between the upper and the upper surface of the foam midsole component, and (c) an intermediate portion between the first and second ends of the first elongated wire or textile component that loops around the first lateral side lace receiving opening or eyelet corresponding to the first elongated wire or textile component, each of the second elongated wire or textile components includes: (a) a first end located between the upper and the upper surface of the foam midsole component, (b) a second end located between the upper and the upper surface of the foam midsole component, and (c) an intermediate portion between the first and second ends of the second elongated wire or textile component that loops around the first lateral side lace receiving opening or eyelet corresponding to the first elongated wire or textile component, each of the third elongated wire or textile components includes: (a) a first end located between the upper and the upper surface of the foam midsole component, (b) a second end located between the upper and the upper surface of the foam midsole component, and (c) an intermediate portion between the first and second ends of the third elongated wire or textile component that loops around the first medial side lace receiving opening or eyelet corresponding to the third elongated wire or textile component, and each of the fourth elongated wire or textile components includes: (a) a first end located between the upper and the upper surface of the foam midsole component, (b) a second end located between the upper and the upper surface of the foam midsole component, and (c) an intermediate portion between the first and second ends of the fourth elongated wire or textile component that loops around the first medial side lace receiving opening or eyelet corresponding to the fourth elongated wire or textile component.

9. The article of footwear according to claim 2, wherein at least one of the lateral lace support elements includes an elongated textile component that loops around a lateral side lace receiving opening or eyelet, and wherein at least one of the medial lace support elements includes an elongated textile component that loops around a medial side lace receiving opening or eyelet.

10. The article of footwear according to claim 9, wherein a portion of the elongated textile component that loops around the lateral side lace receiving opening or eyelet includes a first portion adjacent the lateral side lace receiving opening or eyelet that is fixed to an exterior surface of the upper and a second portion that is not fixed to the exterior surface of the upper, and wherein a portion of the elongated textile component that loops around the medial side lace receiving opening or eyelet includes a first portion adjacent the medial side lace receiving opening or eyelet that is fixed to the exterior surface of the upper and a second portion that is not fixed to the exterior surface of the upper.

11. The article of footwear according to claim 2, wherein at least one of the lateral lace support elements includes: (a) a first elongated textile component that loops around a first lateral side lace receiving opening or eyelet and (b) a second elongated textile component that loops around the first lateral side lace receiving opening or eyelet, and wherein at least one of the medial lace support elements includes: (a) a third elongated textile component that loops around a first medial side lace receiving opening or eyelet and (b) a fourth elongated textile component that loops around the first medial side lace receiving opening or eyelet.

12. The article of footwear according to claim 11, wherein:

the first elongated textile component includes: (a) a first end located between the upper and an upper surface of the foam midsole component, (b) a second end located between the upper and the upper surface of the foam midsole component, and (c) an intermediate portion between the first and second ends of the first elongated textile component that loops around the first lateral side lace receiving opening or eyelet, the second elongated textile component includes: (a) a first end located between the upper and the upper surface of the foam midsole component, (b) a second end located between the upper and the upper surface of the foam midsole component, and (c) an intermediate portion between the first and second ends of the second elongated textile component that loops around the first lateral side lace receiving opening or eyelet, the third elongated textile component includes: (a) a first end located between the upper and the upper surface of the foam midsole component, (b) a second end located between the upper and the upper surface of the foam midsole component, (c) an intermediate portion between the first and second ends of the third elongated textile component that loops around the first medial side lace receiving opening or eyelet, and the fourth elongated textile component includes: (a) a first end located between the upper and the upper surface of the foam midsole component, (b) a second end located between the upper and the upper surface of the foam midsole component, and (c) an intermediate portion between the first and second ends of the fourth elongated textile component that loops around the first medial side lace receiving opening or eyelet.

13. The article of footwear according to claim 2, wherein the plurality of the lateral lace support elements includes: (a) a first elongated textile component that loops around a first lateral side lace receiving opening or eyelet and (b) a second elongated textile component that loops around the first lateral side lace receiving opening or eyelet, and wherein the plurality of the medial lace support elements includes: (a) a third elongated textile component that loops around a first medial side lace receiving opening or eyelet and (b) a fourth elongated textile component that loops around the first medial side lace receiving opening or eyelet.

14. The article of footwear according to claim 13, wherein:

the first elongated textile component includes: (a) a first end located between the upper and an upper surface of the foam midsole component, (b) a second end located between the upper and the upper surface of the foam midsole component, and (c) an intermediate portion between the first and second ends of the first elongated textile component that loops around the first lateral side lace receiving opening or eyelet, the second elongated textile component includes: (a) a first end located between the upper and the upper surface of the foam midsole component, (b) a second end located between the upper and the upper surface of the foam midsole component, and (c) an intermediate portion between the first and second ends of the second elongated textile component that loops around the first lateral side lace receiving opening or eyelet, the third elongated textile component includes: (a) a first end located between the upper and the upper surface of the foam midsole component, (b) a second end located between the upper and the upper surface of the foam midsole component, and (c) an intermediate portion between the first and second ends of the third elongated textile component that loops around the first medial side lace receiving opening or eyelet, and the fourth elongated textile component includes: (a) a first end located between the upper and the upper surface of the foam midsole component, (b) a second end located between the upper and the upper surface of the foam midsole component, and (c) an intermediate portion between the first and second ends of the fourth elongated textile component that loops around the first medial side lace receiving opening or eyelet.

15. The article of footwear according to claim 1, wherein the plurality of cage components comprises:

a heel cage component covering side and bottom regions of a heel area of the foam midsole component;

a midfoot cage component covering side and bottom regions of a midfoot area of the foam midsole component; and a forefoot cage component covering side and bottom regions of a forefoot area of the foam midsole component.

16. The article of footwear according to claim 1, wherein each of the plurality of cage components is formed at least in part from a foam material having a higher density than the density of the foam material of the foam midsole component.

17. An article of footwear, comprising:

an upper; and a sole structure engaged with the upper, the sole structure including a foam midsole component formed from a foam material and extending from a heel region to a forefoot region, and a plurality of cage components covering side and bottom regions of the foam midsole component, wherein at least one space exists between adjacent cage components of the plurality of cage components, and wherein an exterior surface of the foam material of the foam midsole component spans the at least one space between the adjacent cage components and is exposed in the at least one space between adjacent cage components, wherein the upper includes an instep opening including a plurality of lateral lace support elements on a lateral side of the instep opening and a plurality of medial lace support elements on a medial side of the instep opening, wherein at least one of the lateral lace support elements includes an elongated wire or textile component that loops around a lateral side lace receiving opening or eyelet, and wherein at least one of the medial lace support elements includes an elongated wire or textile component that loops around a medial side lace receiving opening or eyelet.

18. The article of footwear according to claim 17, wherein a portion of the elongated wire or textile component that loops around the lateral side lace receiving opening or eyelet includes a first portion adjacent the lateral side lace receiving opening or eyelet that is fixed to an exterior surface of the upper and a second portion that is not fixed to the exterior surface of the upper, and wherein a portion of the elongated wire or textile component that loops around the medial side lace receiving opening or eyelet includes a first portion adjacent the medial side lace receiving opening or eyelet that is fixed to the exterior surface of the upper and a second portion that is not fixed to the exterior surface of the upper.

19. The article of footwear according to claim 17, wherein at least one of the lateral lace support elements includes: (a) a first elongated wire or textile component that loops around a first lateral side lace receiving opening or eyelet and (b) a second elongated wire or textile component that loops around the first lateral side lace receiving opening or eyelet, and wherein at least one of the medial lace support elements includes: (a) a third elongated wire or textile component that loops around a first medial side lace receiving opening or eyelet and (b) a fourth elongated wire or textile component that loops around the first medial side lace receiving opening or eyelet.

20. The article of footwear according to claim 17, wherein at least one of the lateral lace support elements includes an elongated textile component that loops around a lateral side lace receiving opening or eyelet, and wherein at least one of the medial lace support elements includes an elongated textile component that loops around a medial side lace receiving opening or eyelet.

* * * * *